US010845057B1

(12) United States Patent
Smith et al.

(10) Patent No.: US 10,845,057 B1
(45) Date of Patent: Nov. 24, 2020

(54) METHOD AND APPARATUS FOR CONTROLLING OPERATION OF GAS RANGE TOP BURNERS FOR COOKING

(71) Applicants: Todd A. Smith, Cleveland, TN (US); Matthew H. Brown, Cleveland, TN (US)

(72) Inventors: Todd A. Smith, Cleveland, TN (US); Matthew H. Brown, Cleveland, TN (US)

(73) Assignee: Brown Stove Works, Inc., Cleveland, TN (US)

( * ) Notice: Subject to any disclaimer, the term of this patent is extended or adjusted under 35 U.S.C. 154(b) by 598 days.

(21) Appl. No.: 15/674,828

(22) Filed: Aug. 11, 2017

(51) Int. Cl.
*F24C 3/12* (2006.01)
*F23N 5/24* (2006.01)

(52) U.S. Cl.
CPC ..... *F24C 3/124* (2013.01); *F23N 5/245* (2013.01)

(58) Field of Classification Search
CPC ..... F24C 3/124; F23N 5/245
See application file for complete search history.

(56) References Cited

U.S. PATENT DOCUMENTS 4,492,336 A * 1/1985 Takata ..... G05B 13/02
236/20 A

* cited by examiner

*Primary Examiner* — Alfred Basichas
(74) *Attorney, Agent, or Firm* — Stephen J. Stark; Miller & Martin PLLC

(57) ABSTRACT

A gas range has burner head which have temperature sensing devices as a portion of the burner heads. Upon reaching a predetermined temperature, the temperatures sensing devices reduces gas flow to a bypass amount until temperature drops below to at least the predetermined temperature. Lowering the temperature in a cooking utensil below a common ignition temperature, while still allowing boiling, is an objective of many embodiments.

20 Claims, 4 Drawing Sheets

Prior Art

METHOD AND APPARATUS FOR CONTROLLING OPERATION OF GAS RANGE TOP BURNERS FOR COOKING

FIELD OF THE INVENTION

The present invention relates to a method and devices for controlling the temperature of kitchen utensils on a gas burner such as a surface burner element on a gas cooking appliance often referred to as a gas range.

BACKGROUND OF THE INVENTION

Natural gas and propane have been used to supply gas ranges for many years, probably over a century. In current constructions, a controlled stream of gas (typically natural or propane gas) is injected into a burner where it mixes with air to form a combustible mixture. An ignition source ignites the gas as it is emitted from burner ports to create heat generating flames. Cooking pans, pots, and other utensils are supported over the flames by means of a cooking grate or grid. These types of burners are usually controlled by mechanical valves actuated by control knobs on the exterior of the cooking appliance.

Throughout years of development, the cooking appliance industry has developed many types, shapes, and sizes of top burner designs. Burner designs may protrude up through open aeration bowls, or sealed burners may be installed directly to the main top of the appliance.

There are burner technologies available to offer electronic software based means of controls. While software based controls offer a wide array programmed operating options and safety-minded subroutines, it often produces substantial increases in cost to the final marketable product.

Cooking appliance standards classify top cooking sections as "attended cooking" features. This means that the user should be present to visually observe the heat source and the progress of the food being prepared. Typically, gas burner flames can be observed. The food dish may also require periodic attention such as stirring or draining.

Attended top cooking also implies that the user makes manual control adjustments to regulate cooking heat as needed. This may include turning down the heat setting once a boil has been established.

Many cooking accidents have been attributable to the user of a cooking appliance leaving the appliance unattended while performing what should have been attended top cooking. While the user is not present to make heat setting adjustments, pots of water may boil over or boil dry, or cooking oils may overheat and ignite thereby creating a fire which can be extremely problematic inside one's residence and/or business. While software based controls can be programmed to add a degree of protection to top surface cooking, there is still no absolute replacement for conscientious cooking practices.

For electric cooktops, U.S. Pat. No. 6,246,033 provides a method and apparatus for controlling operation of a range top heating element. After ten years of use in the market, this device still has not received wide-spread acceptance. Specifically, when installed on test ranges by the applicant, the device has consistently prevented water from boiling.

The applicant developed another technology for electric ranges in U.S. Pat. No. 9,220,130, which is a substantial improvement over prior art constructions. However, both of these solutions relate to electric stove eyes.

For gas ovens, a type of mechanical control is a temperature based gas flow reduction device. This device usually takes the form of a flexible diaphragm or membrane. The device is normally incorporated in such a way where it can be influenced by heating of the oven compartment, many times as part of a larger thermostat control in the appliance. The device allows nominal gas to flow to the burner with no restriction as long as temperature parameters are below the desired targets. This type of control is shown in FIGS. 1*a* and 1*b*.

In the event that the temperature reaches or exceeds the desired targets within the heated control space, the device actuates to cause a restriction in gas flow to the burner. This restricted gas flow will produce less heat than at nominal rates and allow temperatures in the control space to stop increasing. Once temperatures in the control space drop to desired levels, the device can actuate to return gas flow to normal. These temperature sensors are normally located on or in walls of the oven (not within a perimeter of a cooking article support surface).

However, to the applicant's knowledge, no effort has been made to provide a solution for gas fueled range top burners. Accordingly, an improved system which still allows water to boil is believed to be desirable.

SUMMARY OF THE INVENTION

It is an object of many embodiments of the present invention to provide at least one of a device and method for limiting the temperature of potentially combustible material in cooking articles on a gas fueled exposed eye(s) of a range or other cooking device.

It is another object of many embodiments of the present invention to provide an improved device and method for remotely sensing temperatures at a location spaced from the producing flame region of a gas burner element so as not to sense a significant amount of conducted heat, but, for many embodiments, instead primarily sense radiant heat, and if exceeding a predetermined value, reducing gas flow through the burner orifice and/or ports.

It is another object of many embodiments of the present invention to provide an improved apparatus and method for sensing temperature related to a gas burner element through use of a sensor device installed at the burner head connected intrinsically within the gas supply tubing design, whereby gas from a gas inlet is directed through the sensing device and then supplied to the burner orifice.

Accordingly, in accordance with a presently preferred embodiment of the present invention, an improved method and apparatus for controlling operation or installation of a gas fueled range burner is provided. Specifically, a temperature sensing device is preferably located along within a burner head and/or preferably proximate to a burner head to sense temperature relative to a cooking utensil or article such as a pan, pot, skillet, etc., to attempt to keep the temperature of the cooking utensil and material therein below an ignition temperature of material commonly cooked on ranges.

Accordingly, a heat sensing device switch can be provided possibly as a portion of the burner head in an effort to reduce temperatures below a targeted threshold in the cooking appliance placed thereon at an upper limit by reducing gas flow to an orifice and then restoring normal flow when temperature is below a lower limit. While not guaranteeing the elimination of cooking fires, the statistical likelihood of such a fire can be dramatically reduced.

Specifically, for at least some embodiments the heat sensing device can be connected to a burner head and/or be mounted within a volume of a burner head preferably with the heat sensing device physically connected to the burner head. The heat sensing device can provide a flow reduction valve in communication with the gas inlet which then directs flow to a gas orifice in the burner head and/or to the gas ports. If needed, a short supply tube connection, herein referred to as a jumper tube can direct flow from the heat sensing device to the gas orifice where the burner head can then be similar or dissimilar to existing burner head configurations available in the marketplace today.

For many embodiments, the heat sensing device provides a bimetal disc, a flexible membrane or diaphragm, two internal gas chambers, a minimum "bypass" flow regulator, and gas tube connection points. Gas flow enters the inlet and proceeds to an outlet past the regulator (flexible diaphragm) which is controlled by the sensor (bimetal disc). If the heat is too high, the regulator restricts flow. If below the regulated value, or in a reset configuration, normal flow is provided. Unlike U.S. Pat. No. 9,220,130, gas flow is not secured through interaction of the device like electricity is secured in the '130 patent.

The heat sensing device for many embodiments uses the sensor to provide at least a signal if not movement to the regulator to restrict flow when exceeding the target temperature. Minimum flow when in a triggered condition can be adjusted for many embodiments, such as with a set screw, or otherwise.

BRIEF DESCRIPTION OF THE DRAWINGS

The particular features and advantages of the invention as well as other objects will become apparent from the following description taken in connection with the accompanying drawings in which:

FIG. 3*b* is a bottom perspective view of the burner head shown in FIG. 2 removed from the range;

DETAILED DESCRIPTION OF THE DRAWINGS

Figure 1A:
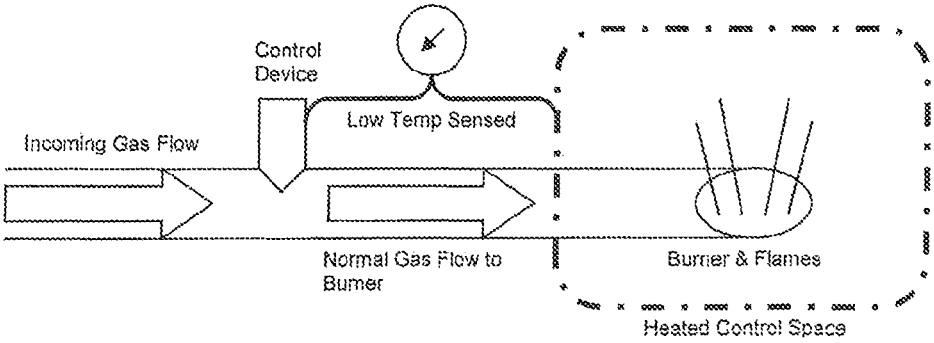
Figure 1a Prior Art
FIGS. 1*a* and 1*b* are schematic views of a prior art oven temperature control system.
Figure 1B:
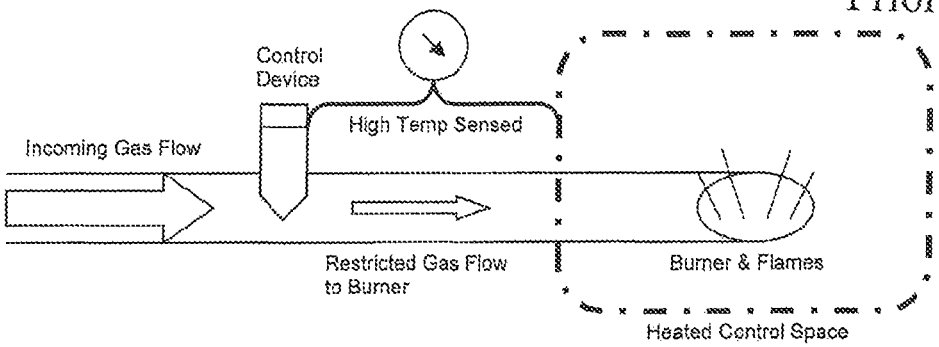
Figure 2:
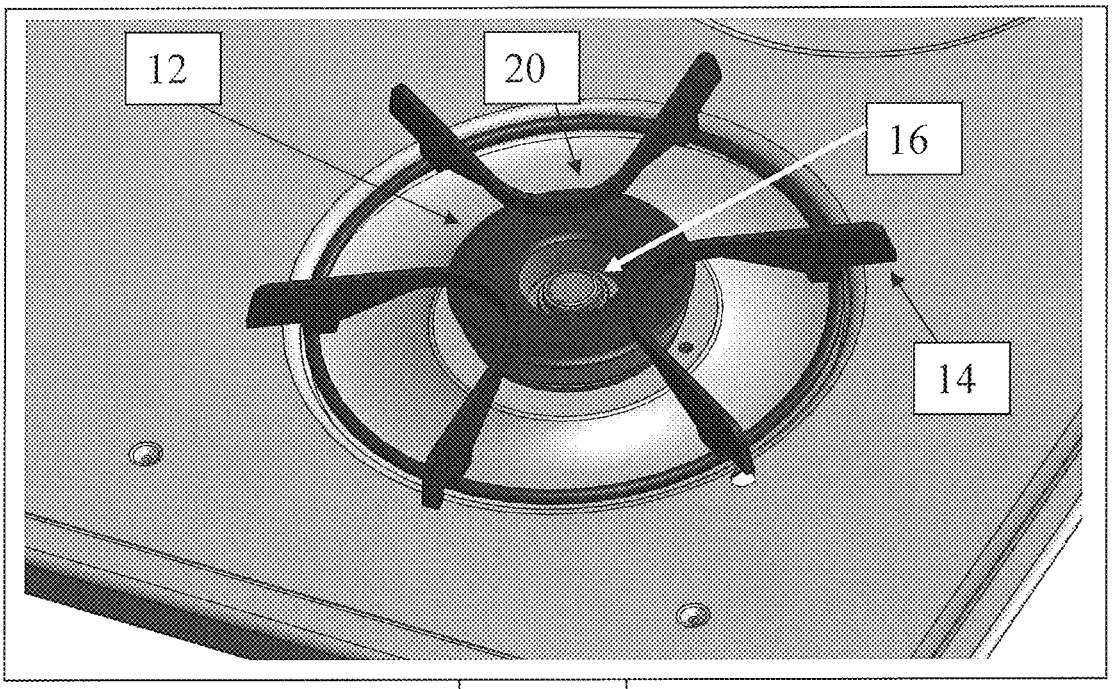
FIG. 2 is a top perspective view of a presently preferred embodiment of the present invention installed in a top burner of a range.

FIG. 2 shows a presently preferred embodiment of the present invention in the form of a gas cooking appliance such as a gas range 10 having burner elements or burner heads 12 shown as a part of the range 10. Gas ranges 10 can include gas cooktops and gas overs. Burner heads 12 normally were exposed on an upper surface of the gas range 10. Each one of the burner head(s) 12 is normally connected into a gas supply tube 18 (shown in FIG. 3) which connects to a gas supply 19 providing a burnable gas (such as propane or natural gas) to the range 10 normally through a control valve 21 operated by an operator 23 such as a dial (for selecting off, simmer, low, medium, and/or hot, etc.). Cooking grid(s) or grate(s) 14 can take a variety of shapes configurations to support cooking pans, pots, and other utensils such as a cooling article support surface above flames of flame ports 24 provided through and/or directed from, the burner head (s) 12 as would be understood by those of ordinary skill in the art.

Figure 3A:
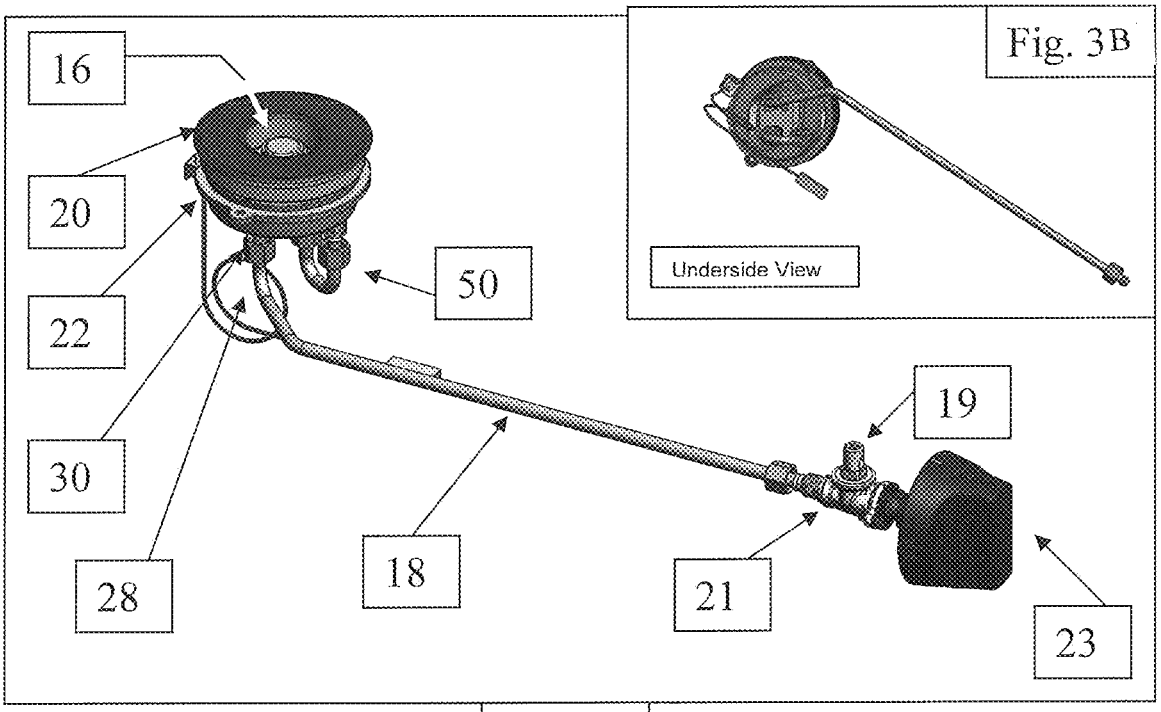
FIG. 3*a* is a top perspective view of the burner head shown in FIG. 2 removed from the range.

Although FIG. 2 shows the temperature sensing device 16 located within a perimeter of a burner cap 20, and/or an outer perimeter of the cooking article support system 17 and within gas/air mixing chamber 22 having flame ports 24 disposed about a perimeter, normally circumferentially thereabout, these structures may be better understood with reference to FIGS. 2-3. In fact, temperature sensing device 16 may be disposed centrally (concentrically, even) with respect to burner head 12, burner cap and/or mixing chamber 22, possibly for mixing air with gas from the gas supply 19 before directing from the flame ports 24 for at least some preferred embodiments. Burner cap 20 may be donut shaped as illustrated to accommodate a circular opening 26 through which temperature sensing device 16 can be radiantly heated by a cooking article on the burner head 12.

Figure 4:
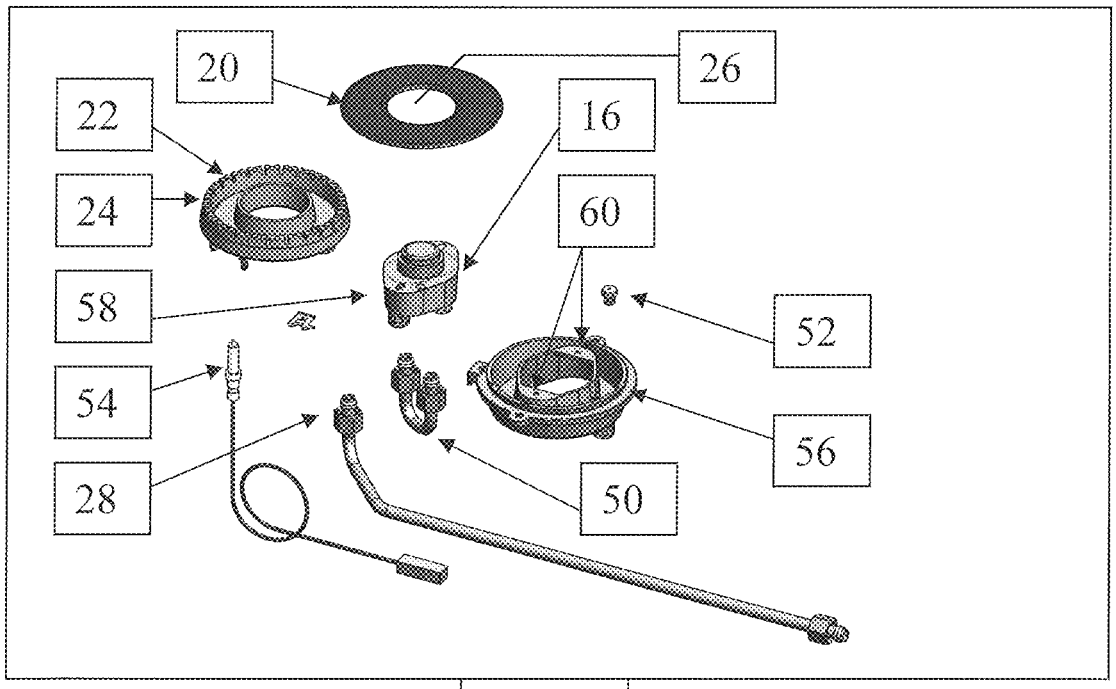
FIG. 4 is an exploded view of the burner head shown in FIG. 3.
Figure 6:
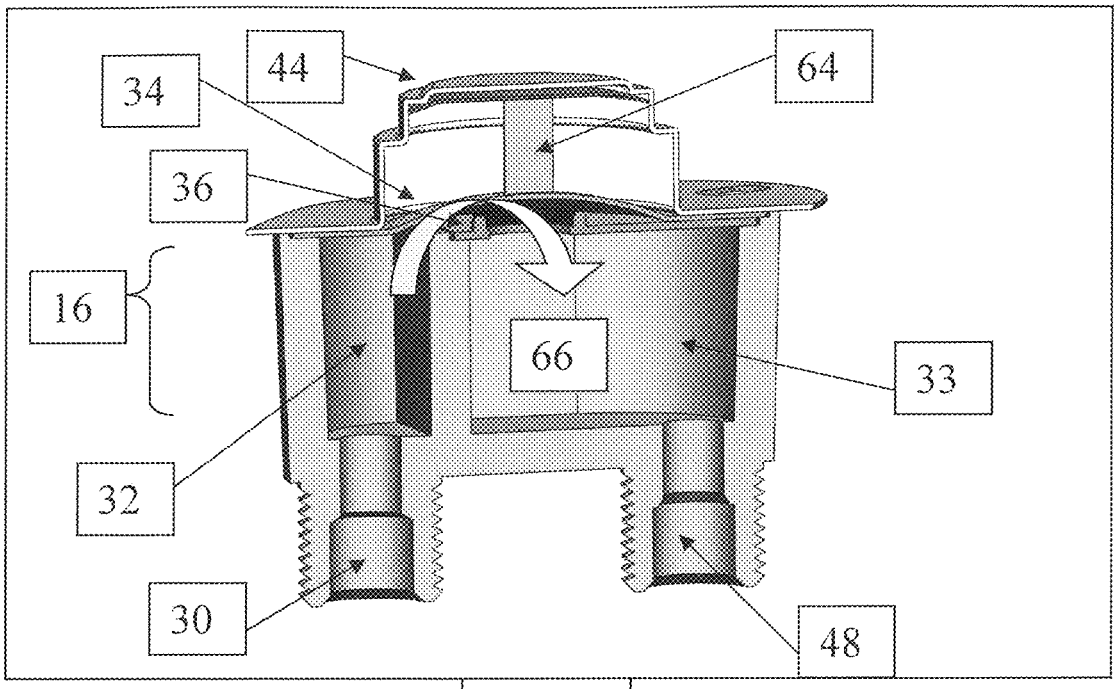
FIG. 6 is a cross sectional view taken along the line A-A in FIG. 5.

Gas supply tube 18 connects to a gas supply providing fuel from the range 10 such as from user control valves as would be understood by those of ordinary skill in the art. It is shown, particularly with reference to FIGS. 4 and 6 connecting with a connection 28 to inlet connection 30 of temperature sensing device 16. Inlet connection 28 directs gas flow into a first internal gas chamber 32 which is in communication with a second internal gas chamber 33 via the regulator 34, illustrated as a flexible diaphragm over bore 36, as well as through bypass passage 38 which can be adjusted in flow, for at least some embodiments, such as with a set screw 40 received in bore 42.

The set screw 40, at times referred to as a bypass adjustment, is a technique used to set minimum amount of restricted gas flow 38 when the sensing device actuates due to sensor temperatures. The set screw 40 can be provided with at least some embodiments of the present invention as would be understood by those of ordinary skill in the art.

Sensor 44 may be mechanical in nature such as a bimetallic disc, configured to at least provide a signal to, if not direct movement of regulator 34 upon reaching a temperature limit from a normal flow configuration, or fully opened position, toward reduced flow configuration or a shut position, if not into a shut position whereby flow is at least slowed to a significant degree is not stopped through the bore 36. Sensor 44 may be located within a zone proximate to the cooking zone under influence of the heat from burner head 12 such as the location as shown in FIG. 2 or others. (Bypass passage 38 will be discussed in further detail below.) Gasket 62 may help in such an effort.

Once a temperature of sensor 44 is above a threshold which may be a predetermined and/or upper temperature limit, the regulator 34 can limit flow. One possible limit could be at or about 375 degrees Fahrenheit or other appropriate setting (possibly lower or higher). A reset temperature or predetermined lower limit such as a percentage less, i.e., about 5 percent less by way of example, or a temperature such as 350 degrees Fahrenheit or other temperature may also be provided. Some embodiments may have a lower limit or another value. For at least a preferred embodiment, the sensor 44 resets the regulator 34 to a fully opened position and the normal flow configuration at the lower limit. Remember, this does nothing as it relates to what the operator has set the burner head 12 to operate by control valve 21 with operator 23, for the presently preferred embodiment, which direct how much gas is directed through the supply tube 18, only how much fuel is allowed to pass through the temperature sensor device 16 when the sensor 44 detect a temperature exceeding the temperature limit. The upper limit activates a regulating device (i.e., such as regulator 34) to reduce burner heat before cookware or cooking items reach an overheated condition. The lower limit is less than the upper limit to allow dissipation of heat before returning to normal operation. Pushrod 64, such as ceramic pushrod, or other device may be useful to couple the sensor 44 to the regulator 34, or other embodiments may be able to have a sensor 44 which can act as the flexible diaphragm to be the regulator 34 as well. Flow rate in the reduced flow configuration is less than when in the normal flow configuration.

Second internal chamber 33 is in communication with outlet 48 which directs a flow of gas through jumper tube 50 to an orifice 52 which can then mix with air in the mixing chamber 22 and be directed out of the ports 24 to provide flames which heat the cooking article on the burner head 12. Ignitor is illustrated as a spark ignition electrode 54 is provided to initiate ignition of the gas/air mixture proceeding from the ports 24. An orifice holder 56 can support the orifice 52, possibly together with the heat sensing device 16, possibly by having the heat sensing device connect with ears 58 to supports 60 internal to the orifice holder 56.

The orifice holder 56 could support the mixing chamber 22 as illustrated, or there could be other constructions for other embodiments. The burner cap 20 is normally supported by the mixing chamber 22, but there could be other constructions with other embodiments.

Although a standing range 10 is shown, slide in, or drop in or any other cooking range 10 having gas supplied eyes as burner head(s) 12 are contemplated particularly those having temperature sensing devices 16 as shown or as otherwise provided.

What distinguishes many embodiments of the applicant's range 10 from prior art ranges is the operation and/or existence of temperature sensing device 16, possibly as a portion of the burner head(s) 12, or at least provided with each of the burner head(s) 12, etc. Temperature sensing device 16 provides an ability to slow gas flow through the burner head 12 to a bypass amount should the temperature exceed a predetermined upper limit or threshold at the temperature sensing device 16, so that further heating cannot occur significantly (while not allowing the flame to extinguish) so that flammable items which may possibly be a kitchen utensil on top of the element 12,18 are not as likely to be ignited or are significantly less likely to ignite than without such protection.

Figure 5A:
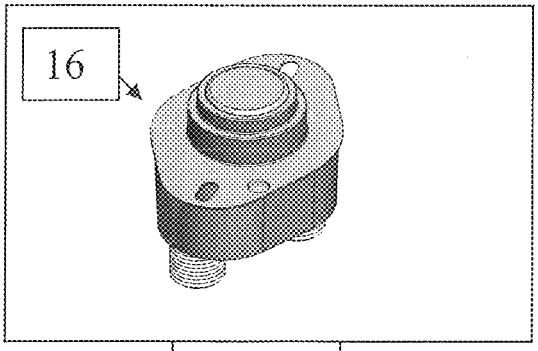
FIG. 5*a* is a bottom perspective view of the heat sensing device shown as a portion of the burner head in FIGS. 2-4.
Figure 5B:
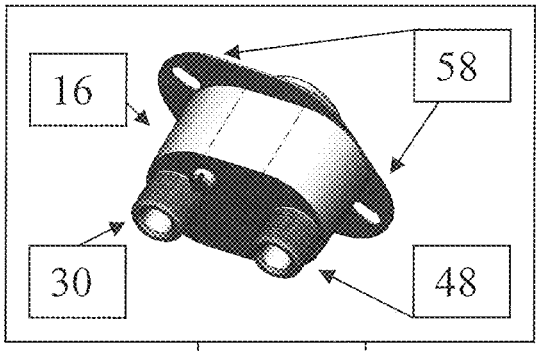
FIG. 5*b* is a top perspective view of the heat sensing device shown as a portion of the burner head in FIGS. 2-4.

Temperature sensing and restriction of gas flow in an overheating condition can be performed by a temperature sensing device 16 possibly incorporating a bimetal disc as sensor 44, a flexible membrane or diaphragm as a regulator 34, two internal gas chambers 32,33, a minimum "bypass" flow passage 38, and gas tube connection points at inlet and outlet 30,48. See FIGS. 5 and 6. These components can be housed in a housing 68 which can surround one or both of the first and second chambers 32 and/or 33 as well as the regulator 34, dividing wall 66, pushrod 64 and/or other components. Inlet 30 and outlet 48 may proceed into and out of housing 68.

The main gas supply tube 18 directs gas from a manual (or other) selectively controllable control valve 21 upstream of the regulator 34 is connected to one of the threaded underside fitting points on the sensor device 16 at inlet 30. This is the entry point for gas into the burner head 12. Gas flows into the first chamber 32 within the sensor device 16. During normal operation, the majority of the gas flows across a divider wall 66 adjacent to the flexible diaphragm and into the second chamber 33. A gasket 62 may be useful to keep a proper seal between the two chambers 32,33, in at least some embodiments. Other embodiments may allow leakage past the regulator 34 to provide, or at least assist in providing, the bypass flow 38. Gas flow is then free to leave the sensor device 16 via the "jumper" tube 50 to travel into the body of the burner head 12, such as to the orifice 52. See FIG. 6.

In the event higher than desired cooking temperatures are sensed, the bimetal disc or other sensor 44 can actuate to push the flexible diaphragm or otherwise create movement of a regulator 34 in such a way that primary gas flow stops or at least slows while permitting bypass flow from the inlet 30 to the outlet 48.

Complete stoppage of gas flow prevents further overheating of cooking utensils. However, this could create an unsafe operating condition when temperatures return to normal and the sensor device restores gas flow. If the burner flame has been completely extinguished by actions of the sensor 44, raw unburned gas/air mixture could be released without ignition unless other technology were employed to prevent such a situation.

In order to prevent complete flame extinction when the device 16 acts to restrict gas flow, a minimum amount of gas flow can still be emitted through the sensor device 16. This minimum gas flow can keep the burner head 12 lit at a very small heat output. As a result, gas ignition can be maintained in a safe manner when the sensor device 16 restores full gas flow.

Figure 7:
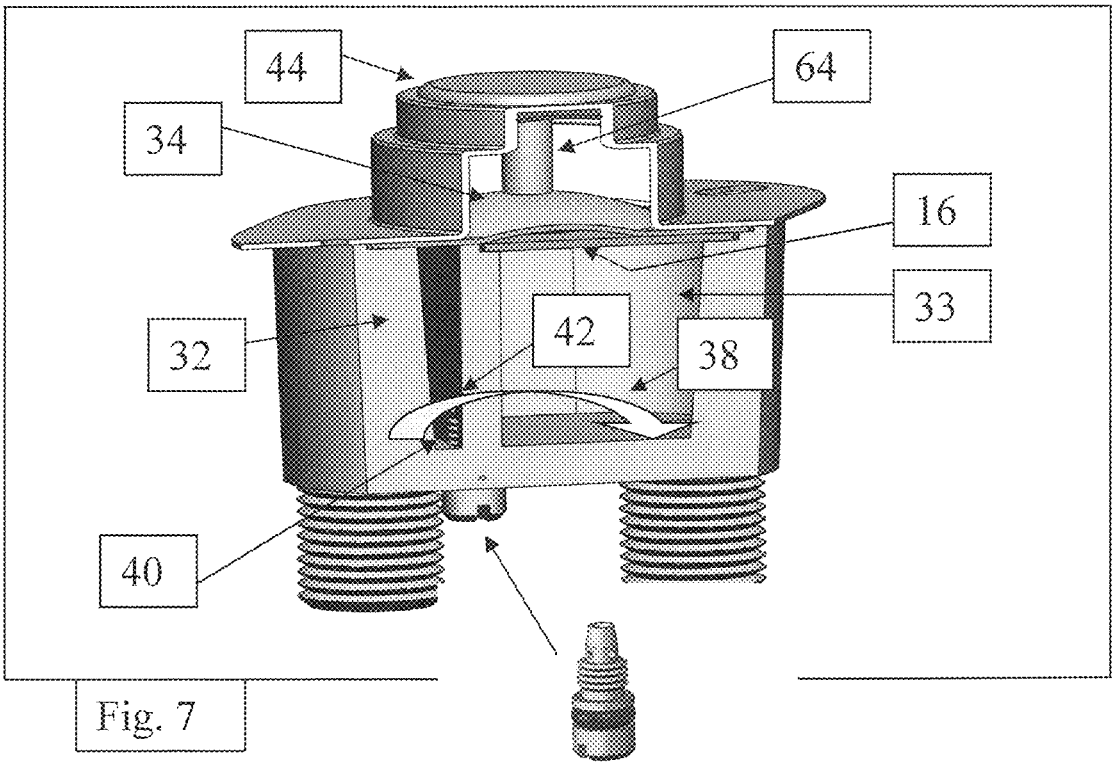
FIG. 7 is a cross sectional view similar to the view of FIG. 6 showing regulated flow through the heat sensing device of FIGS. 5-6.

Control of a minimum safe flow rate of gas through a burner head 12 is often referred to as a "bypass" rate. This is the least amount of gas flow that will still maintain safe combustion by the burner head 12. Bypass rate on a gas controlling device can be adjusted or set for the needs of whatever fuel type (natural gas, propane, etc.) on which the appliance operates. A common design in the industry is to accomplish this with an adjustable set screw 40. See FIG. 7. Other ways of setting or adjusting bypass flow could be provided, particularly if the range 10 could be used with either of propane or natural gas.

Through trial and error, and during development of the invention set forth in U.S. Pat. No. 6,246,033, the temperature rating of the temperature sensing device 16 settings for the sensor 44 for the respective heating or burner heads 12 (also referred to as eyes) were selected by the applicant. Trials were used to arrive at desired temperature settings. Although the temperature setting of 500 degrees Fahrenheit worked satisfactorily for aluminum pans, the applicant discovered that a predetermined temperature of 375 degrees Fahrenheit setting was more desirable for the 8" element when using cast iron skillets due to the amount of heat that could be retained by a cast iron skillet to potentially cause an ignition in at least some situations even with electricity secured to the heating element. Other embodiments may use different temperature settings to actuate the regulator 34 such as about 400, 425, 450, 475, 500 Fahrenheit or potentially anything up to about 700 degrees up to and preferably below about 700 degrees Fahrenheit for the upper predetermined temperature limit. A similar lower temperature limit setting was utilized to restore the full or normal flow of gas (i.e., open the regulator 34) as the upper limit, but various embodiments need not necessarily have the same predetermined temperature for upper and lower settings.

A wide range of temperature sensors 44 are available to the marketplace. A Therm-O-Disc™ brand switch was used particularly effectively by the applicant. These discs come with predetermined settings and the applicant selected about a 375 degree setting (upper and lower limit) for the preferred embodiment although other embodiments can certainly take other temperature settings depending on the placement of the temperature sensor relative to the cooking article and its size and/or other factors.

As can be seen by various embodiments, gas ranges 10 can be made much safer although there is no gadget that can guarantee the prevention of fires in the absence of vigilance by the operator. Gas stoves should be watched at all times by those parties using them.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A gas cooking appliance comprising:

a burner head receiving gas flow from a gas supply, said burner head having flame ports for directing a burning fuel/air mixture therefrom;

a cooking article support surface located above the flame ports;

a temperature sensor having an upper limit and a lower limit below the upper limit, said temperature sensor located within an outer perimeter of the cooking article support surface;

a regulator receiving the gas flow from the gas supply and directing the gas flow toward the flame ports, said regulator actuated mechanically by the temperature sensor; said regulator having a normal flow configuration and a reduced flow configuration whereby the flow rate when in the reduced flow configuration is less than when in the normal flow configuration with the temperature sensor mechanically moving the regulator between the normal flow configuration and the reduced flow configuration;

wherein if the upper limit is reached, the regulator transitions from the normal flow configuration to the reduced flow configuration and the regulator remains in the reduced flow configuration until the lower limit is reached when the regulator transitions to the normal flow configuration.

2. The gas range of claim 1 wherein the burner head is connected to a selectively controllable valve upstream of the regulator.

3. The gas range of claim 1 wherein the flow rate provided in the reduced flow configuration is a bypass rate.

4. The gas range of claim 1 further comprising one of a cooking grate and grid providing, the cooking article support surface to support a cooking article thereon.

5. The gas range of claim 1 wherein gas from the gas supply and air are at least partially mixed prior to leaving the flame ports.

6. The gas cooking appliance of claim 1 wherein the temperature sensor is located within a zone proximate to a cooking zone under influence of heat from the burner head.

7. The gas cooking appliance of claim 6 wherein the temperature sensor is centrally located relative to burner head.

8. The gas cooking appliance of claim 1 wherein the temperature sensor is a bimetallic disc which assists in transitioning the regulator between normal and reduced flow configurations.

9. The gas cooking appliance of claim 1 wherein the upper limit of the temperature sensor is set at a predetermined temperature to actuate a regulating device and create the desired effect of reducing burner heat before cookware and cooking utensils reach an overheated condition.

10. The gas cooking appliance of claim 9 wherein the lower limit of the temperature sensor is less than the predetermined upper limit thereby dissipating heat before restoring normal burner operation.

11. The gas range of claim 9 wherein the upper limit of the temperature sensor is at least about 400 degrees F.

12. The gas range of claim 9 wherein the upper limit of the temperature sensor is at least about 500 degrees F.

13. The gas range of claim 9 further comprising a cooking article support surface located above the flame ports, with said temperature sensor located within an outer perimeter of the cooking article support surface.

14. The gas range of claim 1 wherein the temperature sensor is located within a perimeter of the burner head.

15. A gas cooking appliance comprising:

a burner head receiving gas flow from a gas supply, said burner head having flame ports for directing a burning fuel/air mixture therefrom;

a cooking article support surface located above the flame ports;

a temperature sensor having an upper limit and a lower limit below the upper limit, said temperature sensor located within an outer perimeter of the cooking article support surface;

a regulator receiving the gas flow from the gas supply and directing the gas flow toward the flame ports, said regulator actuated by the temperature sensor; said regulator having a normal flow configuration and a reduced flow configuration whereby the flow rate when in the reduced flow configuration is less than when in the normal flow configuration, the regulator having a flexible diaphragm over a bore with a bypass passage wherein flow through the bore is secured when in the reduced flow configuration; and wherein if the upper limit is reached, the regulator transitions from the normal flow configuration to the reduced flow configuration and the regulator remains in the reduced flow configuration until the lower limit is reached when the regulator transitions to the normal flow configuration.

16. The gas cooking appliance of claim 15 wherein the regulator further comprises first and second chambers in communication through the bore and the bypass passage.

17. The gas cooking appliance of claim 15 wherein the first chamber is in fluid communication with the gas supply, and the second chamber is in communication with the flame ports.

18. The gas cooking appliance of claim 15 further comprising a pushrod connecting the temperature sensor to the flexible diaphragm.

19. The gas cooking appliance of claim 15 wherein the bypass passage is controllably adjustable for flow rate therethrough.

20. A gas range comprising:

a burner head, receiving gas flow from a selectively regulated gas supply from a control valve of the range, said burner head having flame ports for directing a burning fuel/air mixture therefrom;

a mechanical temperature sensor having an upper limit and a lower limit;

a regulator receives the gas flow from the gas supply downstream of the control valve and directs the gas flow toward the flame ports, said regulator mechanically actuated by the temperature sensor; said regulator having a normal flow configuration and a bypass flow configuration whereby the flow rate when in the bypass flow configuration is less than when in the normal flow configuration with the temperature sensor mechanically moving the regulator between the normal flow configuration and the reduced flow configuration;

wherein if the upper limit is reached, the regulator transitions from the normal flow configuration to the bypass flow configuration and the regulator remains in the bypass flow configuration until the lower limit is reached when the regulator transitions to the normal flow configuration.

* * * * *